US010041633B2

(12) United States Patent
Li et al.

(10) Patent No.: US 10,041,633 B2
(45) Date of Patent: Aug. 7, 2018

(54) LIGHTING DEVICE AND LUMINAIRE

(71) Applicant: PHILIPS LIGHTING HOLDING B.V., Eindhoven (NL)

(72) Inventors: Hongxia Li, Shanghai (CN); Yan Xiong, Shanghai (CN); Yemei He, Shanghai (CN); Shi Dong Lin, Shanghai (CN); Qingqing Jiang, Shanghai (CN); Haoyang Shi, Shanghai (CN)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/305,781

(22) PCT Filed: Apr. 8, 2015

(86) PCT No.: PCT/EP2015/057572

§ 371 (c)(1),
(2) Date: Oct. 21, 2016

(87) PCT Pub. No.: WO2015/162004

PCT Pub. Date: Oct. 29, 2015

(65) Prior Publication Data

US 2017/0045184 A1 Feb. 16, 2017

(30) Foreign Application Priority Data

Apr. 21, 2014 (WO) ..... PCT/CN2014/075814
Jun. 12, 2014 (EP) ..... 14172080

(51) Int. Cl.
*F21V 3/02* (2006.01)
*F21V 29/77* (2015.01)
(Continued)

(52) U.S. Cl.
CPC ..... *F21K 9/61* (2016.08); *F21K 9/232* (2016.08); *F21V 3/02* (2013.01); *F21V 3/0625* (2018.02);
(Continued)

(58) Field of Classification Search
CPC ..... F21K 9/232; F21K 9/61; F21K 29/773; F21V 3/02; F21V 3/0625
See application file for complete search history.

(56) References Cited

U.S. PATENT DOCUMENTS

2010/0320904 A1 12/2010 Meir
2011/0175527 A1 6/2011 Ramer et al.
(Continued)

FOREIGN PATENT DOCUMENTS

CN 203176866 U 9/2013
WO 03059012 A1 7/2003
WO 2013017612 A2 2/2013

*Primary Examiner* — Karabi Guharay

(57) ABSTRACT

Disclosed is a lighting device (10) comprising a heat sink (30) having an annular portion (31) including an annular surface portion (33) delimiting a central aperture (37), said annular surface portion (33) carrying a plurality of SSL elements (50); and a bulbous member (20) cooperating with the heat sink (30), said bulbous member (20) having a first surface portion (21) opposite said SSL elements (50) and a second surface portion (22) extending from said first surface portion (21) through said central aperture (37); wherein the bulbous member (20) is used as a light guide member for light emitted by the plurality of SSL elements (50). A luminaire including such a lighting device (10) is also disclosed.

14 Claims, 6 Drawing Sheets

(51) Int. Cl.

| | |
|---|---|
| ***F21K 9/61*** | (2016.01) |
| ***F21K 9/232*** | (2016.01) |
| *F21V 7/22* | (2018.01) |
| *F21Y 103/33* | (2016.01) |
| *F21Y 115/10* | (2016.01) |
| *F21Y 113/13* | (2016.01) |
| *F21V 3/06* | (2018.01) |

(52) U.S. Cl.

CPC ..... *F21V 29/773* (2015.01); *F21V 3/061* (2018.02); *F21V 3/062* (2018.02); *F21V 3/0615* (2018.02); *F21V 7/22* (2013.01); *F21Y 2103/33* (2016.08); *F21Y 2113/13* (2016.08); *F21Y 2115/10* (2016.08)

(56) References Cited

U.S. PATENT DOCUMENTS

| | | | | |
|---|---|---|---|---|
| 2012/0314420 | A1 | 12/2012 | Yamamoto et al. | |
| 2012/0327656 | A1 | 12/2012 | Ramer et al. | |
| 2013/0077285 | A1* | 3/2013 | Isogai ..... | F21V 23/006 362/84 |
| 2013/0257278 | A1 | 10/2013 | Devore et al. | |
| 2013/0335978 | A1* | 12/2013 | Huang ..... | F21V 17/16 362/311.02 |

* cited by examiner

LIGHTING DEVICE AND LUMINAIRE

CROSS-REFERENCE TO PRIOR APPLICATIONS

This application is the U.S. National Phase application under 35 U.S.C. § 371 of International Application No. PCT/EP2015/057572, filed on Apr. 8, 2015, which claims the benefit of Patent Application No. PCT/CN2014/075814, filed on Apr. 21, 2014 and Patent Application No. EP 14172080.5, filed on Jun. 12, 2014. These applications are hereby incorporated by reference herein.

FIELD OF THE INVENTION

The present invention relates to a lighting device comprising a heat sink having an annular surface portion delimiting a central aperture, said annular surface portion carrying a plurality of SSL elements; and a bulbous member cooperating with the heat sink.

The present invention further relates to a luminaire comprising such a lighting device.

BACKGROUND OF THE INVENTION

With a continuously growing population, it is becoming increasingly difficult to meet the world's energy needs and, simultaneously, to control carbon emissions to kerb greenhouse gas emissions which are considered responsible for global warming phenomena. These concerns have triggered a drive towards a more efficient use of electricity in an attempt to reduce energy consumption.

One such area of concern is lighting applications, either in domestic or commercial settings. There is a clear trend towards the replacement of traditional, relatively energy-inefficient, light bulbs such as incandescent or fluorescent light bulbs with more energy efficient replacements. Indeed, in many jurisdictions the production and retailing of incandescent light bulbs has been outlawed, thus forcing consumers to buy energy-efficient alternatives, e.g. when replacing incandescent light bulbs.

A particularly promising alternative is provided by solid state lighting (SSL) devices, which can produce a unit luminous output at a fraction of the energy cost of incandescent or fluorescent light bulbs. An example of such a SSL element is a light emitting diode (LED).

It is known to provide SSL lighting devices having a similar overall shape to incandescent light bulbs, for example, bulbous solid state lighting devices. These bulbous SSL devices may be used to replace incandescent light bulbs or used in similar applications to incandescent light bulbs. However, whereas incandescent lighting devices tend to produce a homogeneous luminous distribution close to 360° around the lighting device, solid state lighting elements act as point sources, such that additional measures are required to produce an SSL-based lighting device that is able to produce a luminous distribution similar in appearance to that of incandescent lighting device such as an incandescent light bulb. Without such measures, the SSL-based lighting device may produce a spotty and/or more restricted luminous output. Such a different appearance typically is not appreciated by consumers, and preferably should be avoided or at least minimized in order to improve the market penetration of SSL-based lighting devices.

An example of a LED-based lighting device having a design to improve the uniformity of the luminous output of the lighting device is disclosed in WO 2013/017612 A2. The disclosed LED lighting assembly has a printed circuit board carrying an LED chip, a heat sink thermally connected with the printed circuit board, wherein the LED lighting assembly further comprises a light guide body configured as a bulb, the light guide body having an inner surface, an outer surface as a light emergent surface and an end surface as a light input coupling surface of light from the LED chip. The inner surface is structured so as to form a reflecting surface towards the outer surface to make at least part of light from the end surface to be reflected and exit through the outer surface.

However, this design has some notable drawbacks. Firstly, due to the fact that the LEDs are enveloped by the end surface of the light guide body, the minimum thickness of light guide body must exceed the width of the LEDs. Such a relatively thick light guide body may compromise the luminous efficiency of the lighting device. Moreover, thermal management of the LEDs may become an issue if a relatively large number of LEDs has to be provided on the printed circuit board, for instance to produce a retrofit light bulb having a luminous output equivalent to a 75 W or 100 W incandescent light bulb, due to the intimate coupling between the light guide body and the LEDs. Finally, due to the fact that the light guide body terminates on the printed circuit board, this lighting arrangement is incapable of generating a luminous distribution closely resembling that of an incandescent light bulb.

US2012/327656A1 discloses solid state type light fixtures each having an optical integrating volume filled with a solid light transmissive material. Such a structure does not have a wall with function of a light guide.

US2011/175527A1 discloses lighting applications such as fixtures and bulbs with a light transmissive structure forming a volume. A one piece light transmissive solid, a gel or a liquid is filling the volume. Such a structure does not have a wall with function of a light guide.

SUMMARY OF THE INVENTION

The present invention seeks to provide a SSL element-based lighting device that may produce a more uniform luminous distribution.

The present invention further seeks to provide a luminaire comprising such a lighting device.

According to an aspect, there is provided a lighting device comprising a heat sink having an annular portion including an annular surface portion delimiting a central aperture, said annular surface portion carrying a plurality of SSL elements; and a bulbous member cooperating with the heat sink, said bulbous member having a first surface portion opposite said SSL elements and a second surface portion extending from said first surface portion through said central aperture.

Due to the fact that the SSL elements are arranged outside the bulbous member, a relatively thin bulbous member may be used as a light guide, thereby achieving satisfactory luminous efficiency of the light guide. This also improves the controllability of the thermal management of the SSL elements. Moreover, because the bulbous member extends beyond the surface portion carrying the SSL elements, the angular luminous distribution of the lighting device may be increased, such that the lighting device more closely resembles the luminous distribution of existing lighting devices such as incandescent light bulbs. Furthermore, due to the relative simplicity of the assembly process of such a lighting device and the relatively small amount of material needed for the bulbous member, the lighting device of the present invention may be manufactured in a cost-effective manner.

The annular portion may further comprise a rim extending from the annular surface portion towards the first surface portion of the bulbous member. This further improves the controllability of the thermal management of the lighting device as the surface area of the part of the heat sink in close thermal coupling with the SSL elements is increased.

The SSL elements may be directly mounted on the annular surface portion of the heat sink. Alternatively, the solid state lighting elements may be mounted on an annular carrier, said annular carrier being supported by the annular surface portion. This facilitates a more straightforward assembly of the lighting device.

The bulbous member may comprise a bulbous portion connected to a tapered annular portion by a joining portion including the first surface portion, said tapered annular portion comprising the second surface portion and extending into the heat sink through said central aperture. The tapered annular portion may guide the light generated by the SSL elements into the heat sink. This is particularly advantageous if the heat sink further comprises a further portion for engaging with a fitting of the lighting device and a plurality of fins extending from the annular portion to said further portion, wherein the plurality of fins are spaced apart such as to define a plurality of light exit windows in between said fins. In this embodiment, light exiting the tapered annular portion may exit the lighting device through the plurality of light exit windows, thereby further increasing the angular luminous distribution of the lighting device.

In an embodiment, the bulbous member comprises a reflective coating on an inner surface portion centered on an optical axis of the lighting device. Such a reflective coating may assist in improving the homogeneity of the luminous output of the lighting device, as well as assist in increasing the angular luminous distribution thereof. For instance, it may be possible to produce a lighting device meeting Energy Star requirements by the inclusion of such a reflective coating.

Any suitable reflective coating may be considered. In a particularly advantageous embodiment, said coating comprises $TiO_2$, as titanium oxide can be deposited in particulate form using a suitable solvent such as butyl acrylate, which facilitates the formation of the reflective coating inside the bulbous member.

The coating may cover a circular section of said inner surface portion, wherein the bulbous member has a maximum diameter, and said circular section has a diameter in the range of 25-50% of said maximum diameter. It has been found that when the coating is dimensioned within this range, a lighting device may be provided meeting Energy Star requirements.

In an embodiment, the bulbous member has a wall thickness in the range 20-50% of the width of an individual SSL element on said annular surface portion.

In an embodiment, the bulbous member is translucent to obscure the internals of the lighting device.

The bulbous member may be made of glass or a polymer. When the lighting device is made of a polymer, the polymer may for instance be selected from polycarbonate, polyethylene terephthalate and poly (methyl methacrylate) such polymers are known to have suitable optical properties.

In an embodiment, the solid state lighting elements are light emitting diodes.

In an embodiment, the lighting device is a light bulb.

According to another aspect, there is provided a luminaire comprising the lighting device according to one or more of the aforementioned embodiments. Such a luminaire may for instance be a holder of the lighting device or an apparatus into which the lighting device is integrated.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
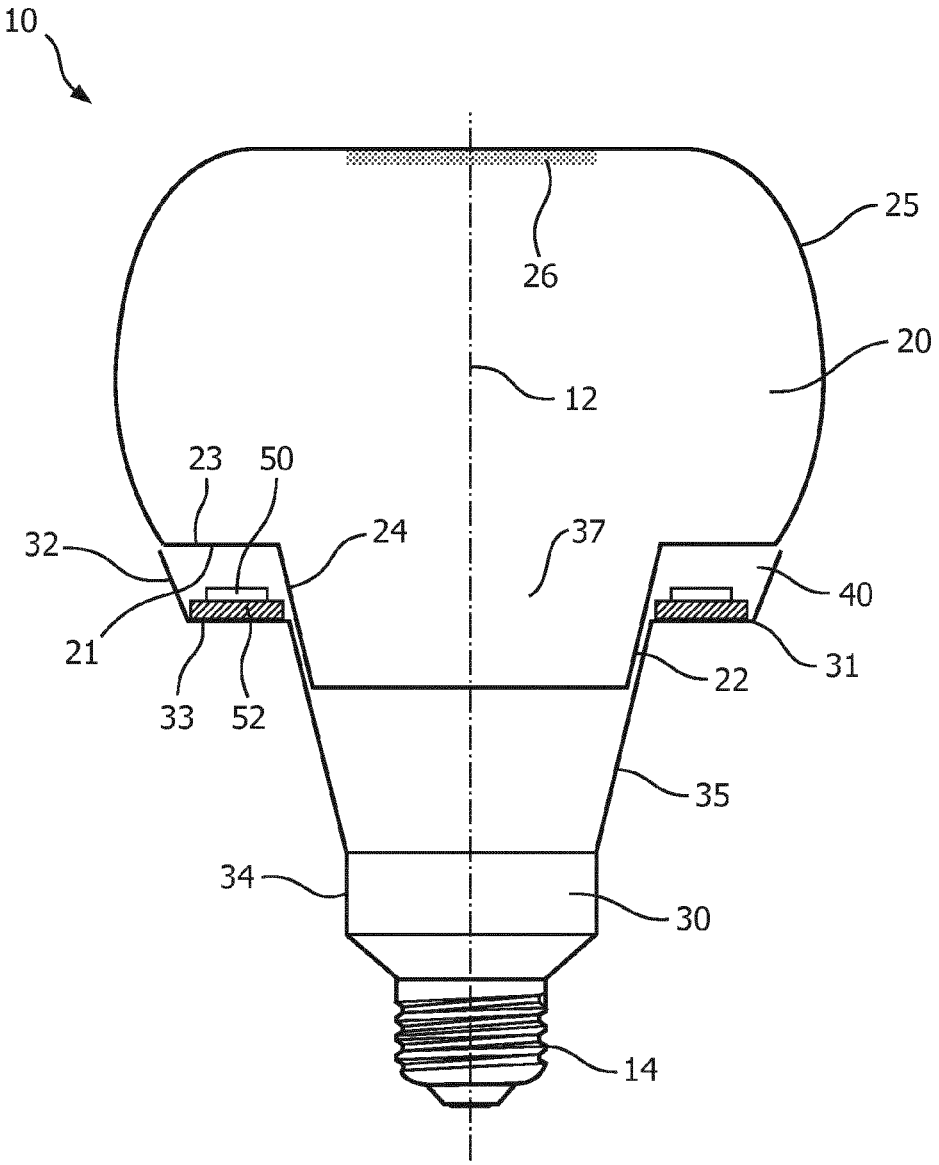
FIG. 1 schematically depicts a cross-section of a lighting device according to an embodiment.

It should be understood that the Figures are merely schematic and are not drawn to scale. It should also be understood that the same reference numerals are used throughout the Figures to indicate the same or similar parts.

Figure 2:
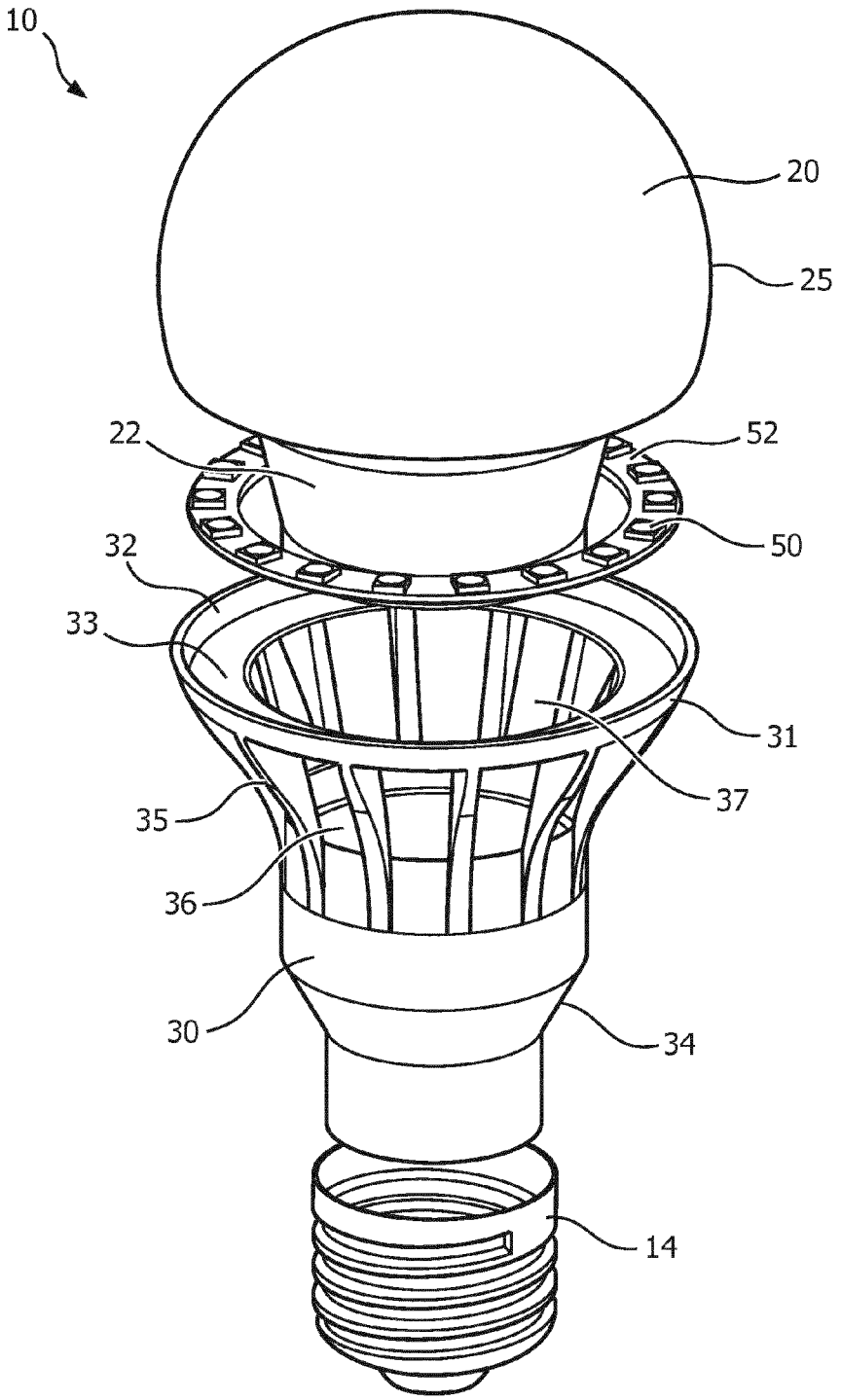
FIG. 2 schematically depicts an exploded view of a lighting device according to an embodiment.
Figure 3:
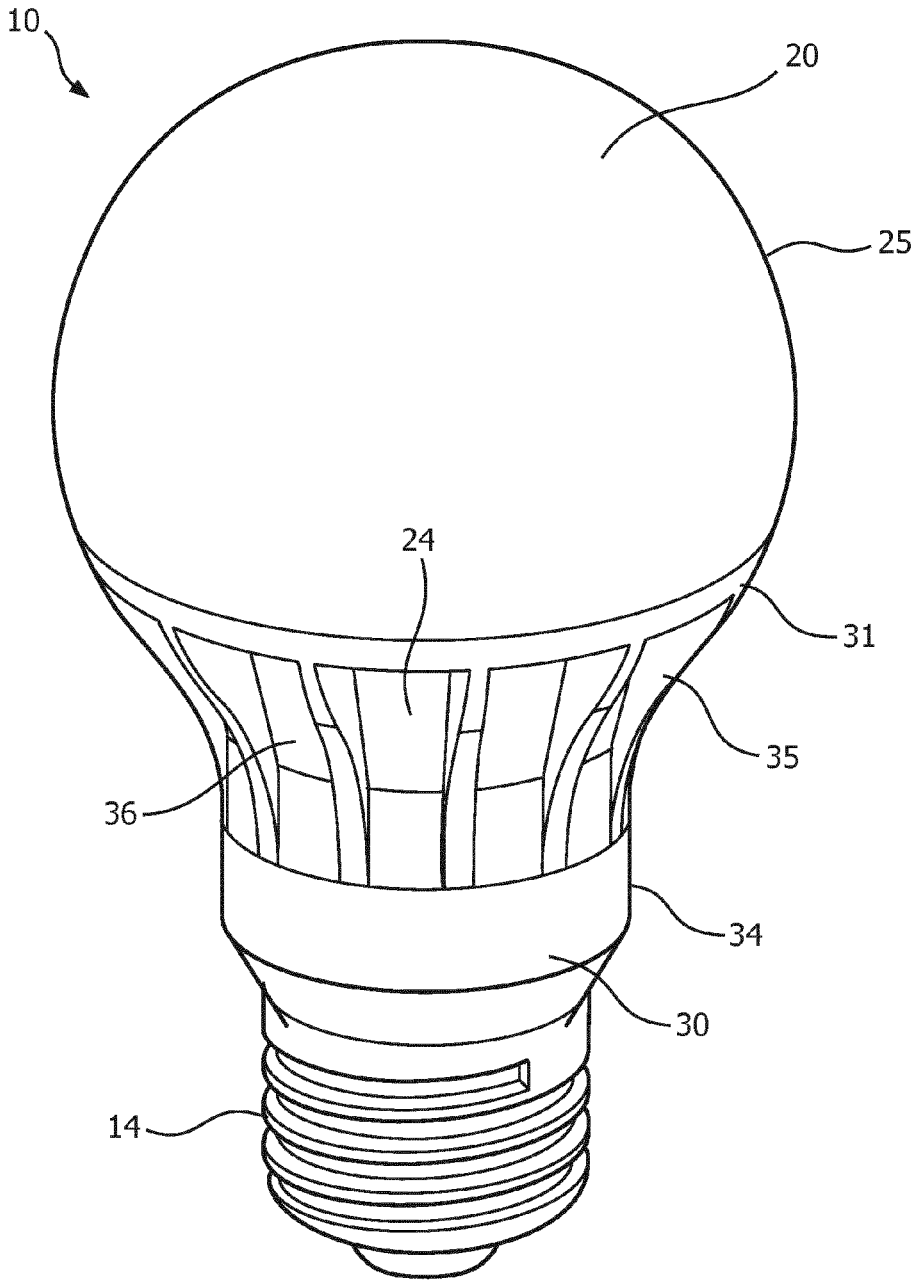
FIG. 3 schematically depicts a perspective view of a lighting device according to an embodiment.

A cross-section of an embodiment of a lighting device 10 according to the present invention is schematically depicted in FIG. 1. FIG. 2 schematically depicts the lighting device of FIG. 1 in an exploded view and FIG. 3 schematically depicts the lighting device of FIG. 1 in a perspective view. The same reference numerals in these figures are depicting the same elements unless explicitly stated otherwise.

The lighting device 10 comprises a bulbous member 20 engaging with a heat sink 30 to form the overall shape of the lighting device 10. The bulbous member 20 is typically made of a material through which light can travel, such as glass or an optical grade polymer, for example polycarbonate, PMMA, PET or the like. The material may be transparent or translucent; for instance, if the material is a translucent material the internals of the lighting device 10 may be prevented from being directly observed by an external observer, thereby improving the aesthetic appearance of the lighting device 10.

The heat sink 30 may be made of any suitable heat conductive material, such as a suitable metal. By way of non-limiting example, the heat sink 30 may be made of aluminium or an aluminium alloy although it will be apparent to the skilled person that other metals or metal alloys may also be used. The heat sink 30 comprises an annular portion 31 including an annular surface portion 33 and a rim 32 extending upwardly from the outer edge of the annular portion 31 towards the bulbous member 20, such as towards a first surface portion 21 of the bulbous member 20. In an embodiment, the rim 32 extends towards and contacts the bulbous member 20.

The annular surface portion 33 delimits a central aperture 37 in the heat sink 30. The annular portion 31 defines a holder for a plurality of solid state lighting (SSL) elements 50, which are either directly mounted on the annular surface portion 33 or are mounted on an annular carrier 52, which carrier may be mounted on the annular surface portion 33.

The annular carrier 52 is typically dimensioned to coincide with the annular surface portion 33. Any suitable carrier 52, e.g. a printed circuit board (PCB) or the like may be used to carry the SSL elements 50.

In an embodiment, the SSL elements 50 are LEDs. Any suitable type of LEDs may be considered for inclusion in the lighting device 10. The SSL elements 50 may be chosen such that each SSL element 50 emits light of the same colour or colour temperature. Alternatively, a mixture of SSL elements 50 emitting different colored light or light of different colour temperatures may be included in the lighting device 10.

In an embodiment, the heat sink 30 comprises a further portion 34 engaging with a fitting 14 of the lighting device 10. In FIG. 1-3, a screw fitting is shown by way of non-limiting example only, it should be understood that the fitting 14 may take any suitable shape, such as a bayonet fitting, a GU-type fitting, a MR-type fitting and so on. The further portion 34 may extend from the fitting 14 to the annular portion 31. However, in a particularly advantageous embodiment, the further portion 34 is spatially separated from the annular portion 31. In this embodiment, the heat sink 30 may further comprise a plurality of fins 35 that each extend from the further portion 34 to the annular portion 31.

The shape or form of the fins 35 is not particularly limited; the fins 35 may have any suitable shape or form. In an embodiment, the annular portion 31 of the heat sink 30 has a larger outer diameter than the further portion 34, wherein the fins 35 may curve inwardly from the annular portion 31 towards the further portion 34 as shown in particular in FIG. 2. The fins 35 may extend from the annular portion 31 to further portion 34 in any suitable manner. By way of non-limiting example, the fins 35 may extend from the bottom of the annular surface portion 33 to an outer surface of the further portion 34 of the heat sink 30, although it will be understood by the skilled person that many other suitable arrangements are equally feasible.

The fins 35 are typically separated from each other by a plurality of respective gaps 36. As will be explained in more detail below, the gaps 36 may act as a light exit regions in order to increase the angular range of the luminous distribution produced by the lighting device 10. The gaps 36 may include a material through which light can travel, e.g. a transparent or translucent glass or polymer such that the internals of the lighting device are not exposed to the openings 36. Alternatively, the gaps 36 may remain uncovered. This is for instance a feasible embodiment if the bulbous member 20 extends into the heat sink 30 such that the gaps 36 are covered by part of the bulbous member 20, as will be explained in more detail below.

The bulbous member 20 is typically shaped such that the bulbous member 20 includes a first surface portion 21 facing the light emitting surfaces of the SSL elements 50 and a second surface portion 22 extending from the first surface portion 21 through the central aperture 37 of the heat sink 30. Consequently, the first surface portion 21, the second surface portion 22, the annular surface portion 31 and the rim 30 to cooperate to define an annular or doughnut-shaped compartment 40 in which the SSL elements 50 are housed. Due to the limited contact between the bulbous member 20 and the SSL elements 50 on the one hand and the relatively large contact area between the sink 30 and the SSL elements 50 on the other hand, the thermal management of the heat generated by the SSL elements 50 can be well-managed, and it has been found that lighting devices producing a luminous flux equivalent to a 100 W light bulb can be achieved without the temperature of the number of SSL elements 50 required to produce such a luminous flux exceeding acceptable tolerances.

The bulbous member 20 may act as a light guide member for the light emitted by the SSL elements 50, which may be coupled into the light guide member through the first surface portion 21 and the second surface portion 22 of the bulbous member 20 respectively. In order to increase the amount of light coupled into this light guide member, the rim 32 of the annular portion 31 of the heat sink 30 may be reflective such that light emitted by the SSL elements 50 in the direction of the rim 32 is redirected (reflected) by the rim 32 towards the first surface portion 21 or the second surface portion 32. For the same reasons, the annular surface portion 33 of the annular portion 31 of the heat sink 30 may be reflective. The rim 32 and/or the annular surface portion 33 may be made of a reflective material, e.g. a polished metal or metal alloy such as aluminium or an alloy thereof, or may be coated with a reflective layer such as a reflective foil to achieve the desired reflectivity.

Figure 6:
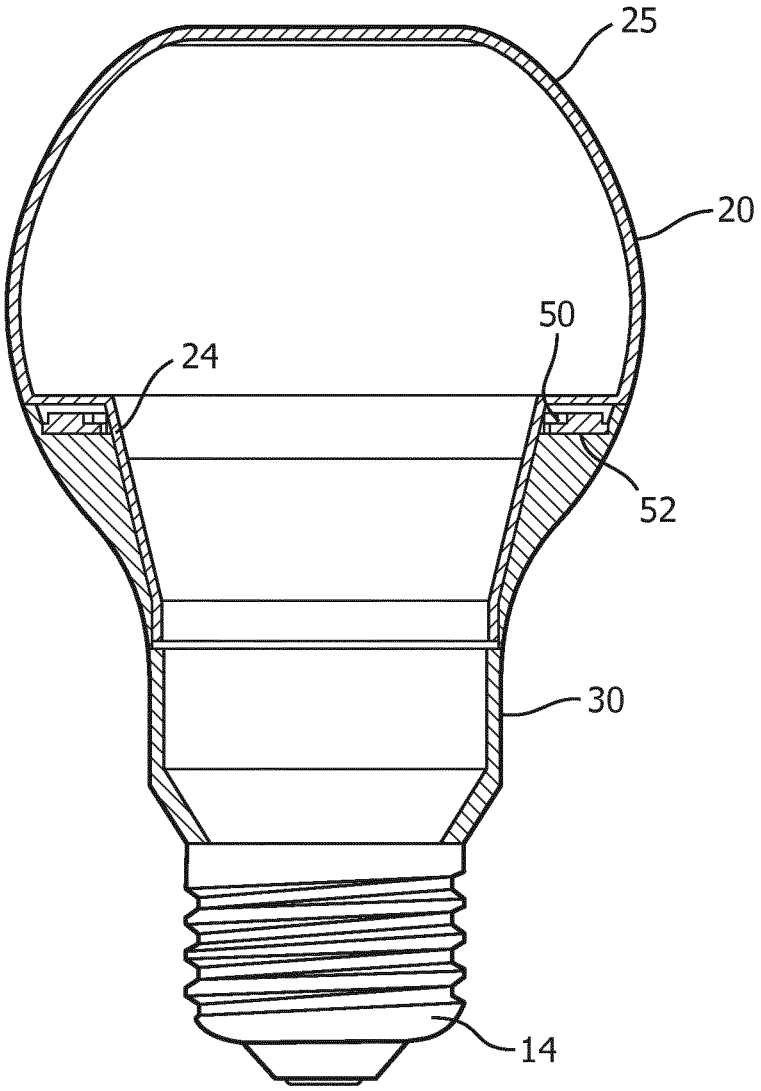
FIG. 6 schematically depicts a sectional view of a lighting device according to an embodiment.

At this point, it is noted that this arrangement allows for a relatively thin bulbous member 20 to be used, this is because the light emitted by the SSL elements 50 is coupled into the light guide member through an external surface thereof rather than by provision of a recess in an end surface of the light guide member as is the case in for instance WO 2013/017612 A2. For instance as shown in FIG. 6, in some embodiments the wall thickness of the bulbous member 20 may be chosen in the range from about 20-50% of the width of an individual SSL element 50. In other words, the wall thickness of the bulbous member 20 is smaller than the typical width of a SSL element 50. For instance, the typical width of an SSL element 50 may be 3 mm, with the typical wall thickness of the bulbous member 20 ranging from 0.5-1.5 mm, e.g. 1 mm. Consequently, the bulbous member 20 used in embodiments of the lighting device 10 can be kept relatively thin, i.e. can be realized using relatively little material, which therefore improves the luminous efficiency of the lighting device 10 as light losses, e.g. through absorption, typically scales with the amount of material the light has to travel through.

The second surface portion 22 of the bulbous member 20 typically extends from the first surface portion 21 through the central aperture 37 of the heat sink 30, such that at least a part of the second surface portion 22 is located below the plane of the central aperture 37, i.e. is located in between the central aperture 37 and the fitting 14. This allows for light to exit the bulbous member 20 acting as a light guide member in regions below the aforementioned plane of the central aperture 37. This is particularly advantageous if the heat sink 30 includes the plurality of gaps 36, such that the light exiting the bulbous member 20 below the plane of the central aperture 37 can exit the lighting device 10 through the plurality of gaps 36. As will be immediately apparent, this may significantly improve the luminous distribution produced by the lighting device 10 as will be demonstrated in more detail below. The second surface portion 22 may partially cover the gaps 36, i.e. the bulbous member 20 may terminate in between the annular portion 31 and the further portion 34 of the heat sink 30. Alternatively, the second surface portion 22 may fully cover the gaps 36, i.e. the bulbous member 20 may terminate at or in the further portion 34 of the heat sink 30. In this latter embodiment, the gaps 36 may not require the inclusion of a cover material, as the coverage of the gaps 36 is provided by the bulbous member 20.

The bulbous member 20 may have any suitable shape. In an example embodiment, the bulbous member 20 may comprise a bulbous body 25 connected to a tapered annular portion 24 by a joining portion 23. The joining portion 23 may include the first surface portion 21 and the tapered annular portion 24 may include the second surface portion 22. The joining portion 23 may be dimensioned such that the outer edge between the joining portion 23 and the bulbous body 25 coincides with the rim 32 of the annular portion 31 of the heat sink 30 and the inner edge between the joining portion 23 and the tapered annular portion 24 allows for the tapered annular portion 24 to extend through the central aperture 37 of the heat sink 30.

Similarly, the bulbous body 25 may have any suitable shape, such as a continuously curved body, a curved body comprising a flattened top section and so on. The bulbous member 20 may be shaped to match the shape of pre-existing incandescent light bulbs such that the lighting device 10 is as similar as possible in appearance to such traditional lighting devices.

In an embodiment, the lighting device 10 further comprises a reflective member such as a reflective coating 26 on an inner surface of the bulbous member 20, such as on an inner surface of the bulbous body 25, or any other suitable reflective member inside the bulbous member 20 for redirecting light towards the lower portion of the lighting device 10, e.g. towards the gaps 36.

In case of a reflective coating 26, the reflective coating 26 preferably is centered on an optical axis 12 of the lighting device 10 and may be arranged to reflect light emitted by the SSL elements 50 through the central aperture 37, e.g. in the direction of the gaps 36 when present, such that the intensity of light exiting the lighting device in the region between the central aperture 37 and the fitting 14 may be increased.

This for instance is relevant if angular dependency in the luminous intensity distribution produced by the lighting device 10 should be kept within predefined tolerances, such as for instance is the case if the lighting device 10 is to meet Energy Star requirements. Part of these requirements mandate that 90% of the luminous intensity produced by the lighting device shall vary by no more than 25% from the average intensity, and that all luminous intensity produced by the lighting device shall vary by no more than 50% of the average intensity produced by the lighting device.

In order to meet requirements such as the Energy Star requirements, the reflective portion 26 may be dimensioned accordingly. For instance, the reflective portion 26 may have a circular shape centered on the optical axis 12 of the lighting device 10, wherein the circular shape has a diameter that is a particular ratio to the maximum diameter of the bulbous member 20. In some embodiments, the diameter of the circular shape may be 25-50% of the maximum diameter of the bulbous member 20. The appropriate dimensioning of the reflective portion 26 ensures that the appropriate amount of light is reflected by the reflective portion 26 towards the lower half, e.g. towards the gaps 36, of the lighting device 10 such that the luminous distribution produced by the lighting device 10 may meet luminous distribution requirements such as the aforementioned Energy Star requirements. For example, for a standard size light bulb, the circular reflective portion 26 may have a diameter of about 20 mm to achieve the desired luminous distribution.

Any suitable reflective coating material may be used for the reflective portion 26. A particularly straightforward manner of applying the coating material to the bulbous member 20 is to provide a dispersion or solution of the reflective coating material in a suitable solvent, deposit a predefined volume of the dispersion or solution in the bulbous member 20 and evaporate the solvent to leave behind the reflective portion 26 on an inner surface portion of the bulbous member 20. In an example embodiment, a dispersion of $TiO_2$ particles, e.g. $TiO_2$ floods, in a solvent such as butyl acrylate may be deposited in this manner, followed by the evacuation of the butyl acrylate to form the reflective portion 26 formed of $TiO_2$. However, it is emphasized that it will be immediately apparent to the skilled person that other suitable reflective materials and/or other suitable solvents may be used for this purpose. As many of such materials and solvents are well-known per se, this will not be explained in further detail for the sake of brevity only.

In some embodiments, the lighting device 10 is a light bulb although it should be understood that alternative embodiments of the present invention are not necessarily limited thereto.

Figure 4:
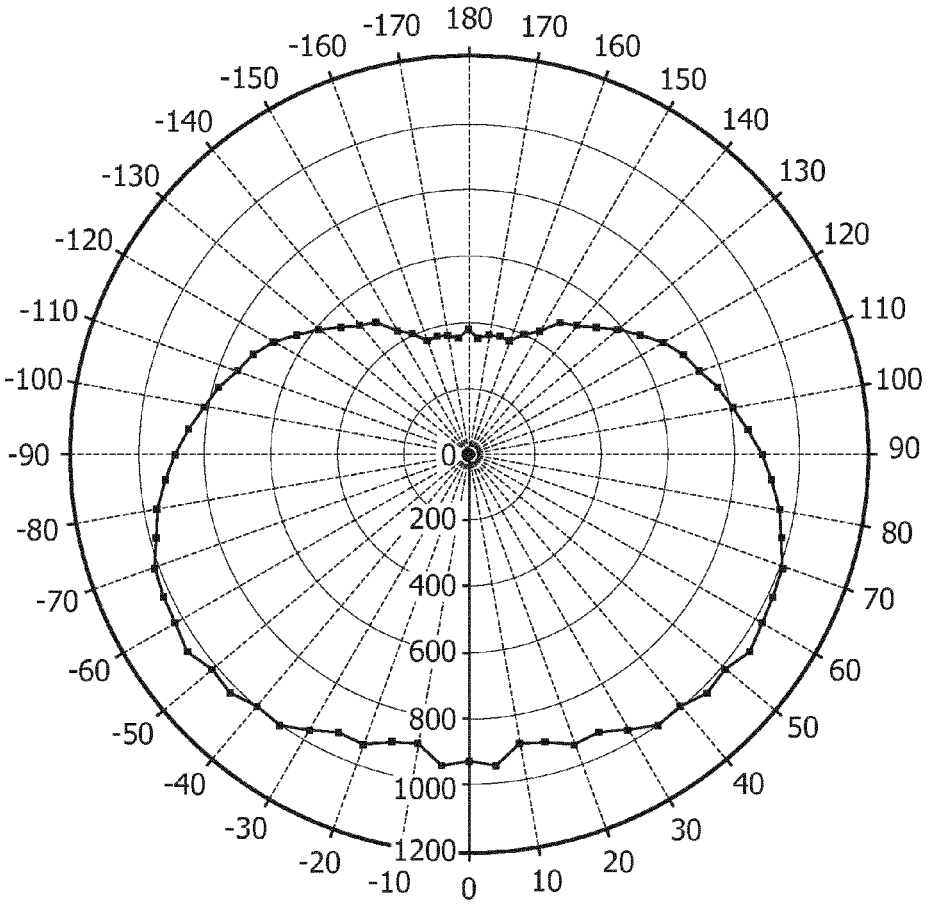
FIG. 4 depicts a luminous distribution plot of a lighting device according to an embodiment.

FIG. 4 depicts a polar plot of the luminous output of a lighting device 10 according to FIG. 3 in which a plurality of fins 35 defines a plurality of gaps 36 in between the annular portion 31 and the further portion 34 of the heat sink 30, and in which a reflective portion 26 is present on the inner surface of the bulbous body 25 and centered on the optical axis 12 as previously explained. In this embodiment, the bulbous body 20 is a plastic body (polycarbonate) and the tapered portion 24 of the bulbous member 20 entirely covers the gaps 36.

This polar plot clearly shows that a luminous distribution over the full 360° range can be achieved, thereby providing a lighting device 10 being similar in (a luminous) appearance to traditional light bulbs such as incandescent light bulbs. The average luminous intensity produced by the lighting device 10 is around 600 lm, with the full intensity range spanning from about 400-1,000 lm, such that it can be recognized that the lighting device 10 of FIG. 3 complies with the Energy Star requirements.

Figure 5:
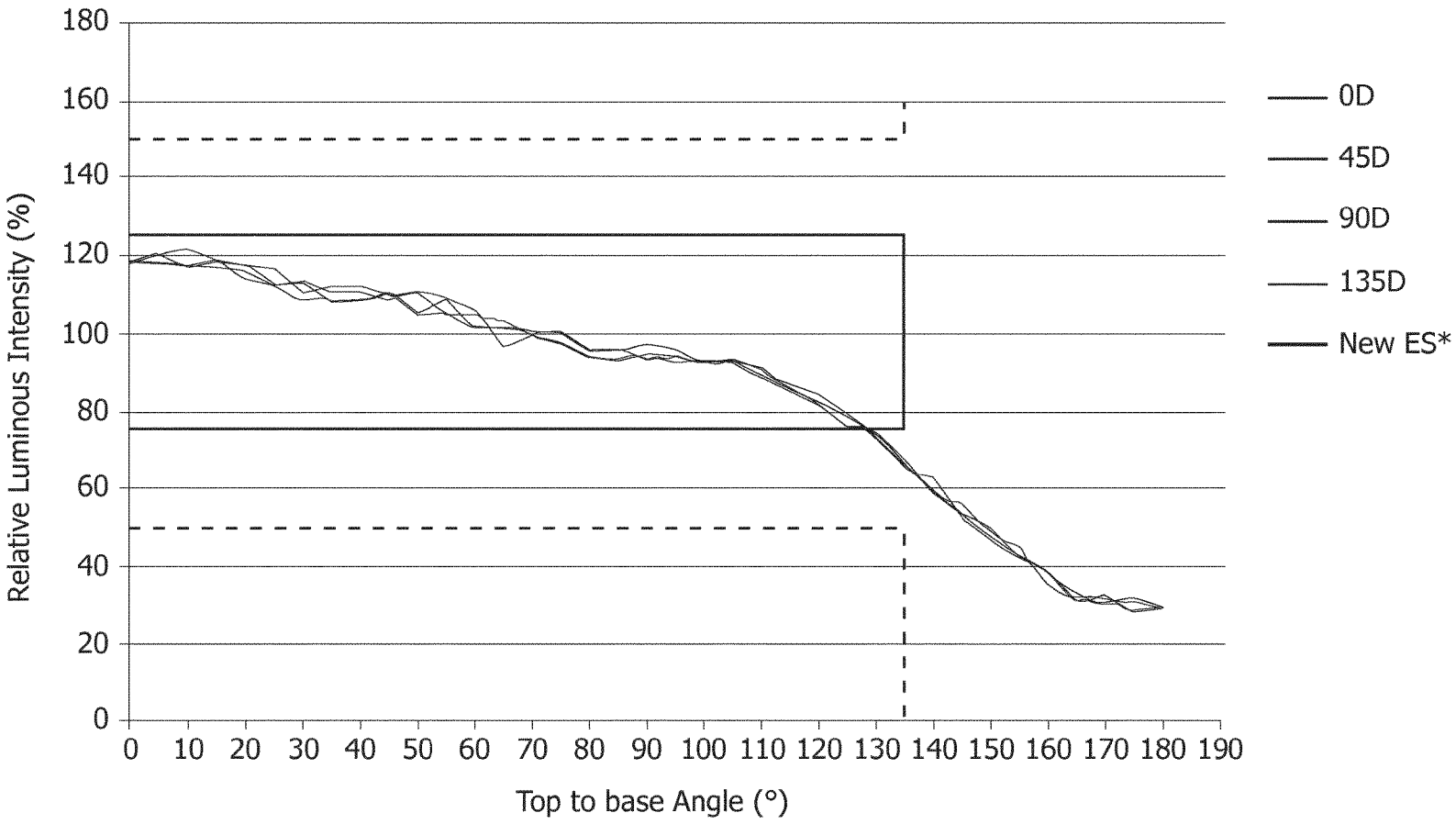
FIG. 5 depicts a relative luminous intensity graph of a lighting device according to an embodiment.

This is also shown in FIG. 5, which depicts the relative luminous intensity (%) of the lighting device 10 as a function of the luminous emission angle relative to the optical axis 12 of the lighting device 10. The solid box in FIG. 5 marks the allowed 25% deviation from the average luminous intensity (Energy Star) for 90% of the measured points of the lighting device 10, whereas the dashed boxes mark the areas beyond the allowed 50% deviation from this average luminescence intensity. As at least 90% of the measured luminous intensity data of the luminescence of the lighting device 10 lies within the solid box and no measured data of the lighting device 10 lies within one of the dashed boxes, it can be seen that the lighting device 10 complies with the Energy Star requirements that for instance are in use in the USA.

The lighting device 10 according to one or more embodiments of the present invention may be advantageously included in a luminaire such as a holder of the lighting device, e.g. a ceiling light fitting, or an apparatus into which the lighting device is integrated, e.g. a cooker hood or the like. Other suitable type of luminaires, e.g. advertising luminaire comprising an array of tubular lighting devices and so on, will be apparent to the skilled person.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising:

a heat sink having an annular portion including an annular surface portion delimiting a central aperture, said annular surface portion carrying a plurality of SSL elements; and a bulbous member cooperating with the heat sink, said bulbous member having a first surface portion opposite said SSL elements and a second surface portion extending from said first surface portion through said central aperture;

wherein the bulbous member is used as a light guide member for light emitted by the plurality of SSL elements; and wherein the bulbous member comprises a bulbous portion connected to a tapered annular portion by a joining portion including the first surface portion, said tapered annular portion comprising the second surface portion and extending into the heat sink through said central aperture.

2. The lighting device of claim 1, wherein the annular portion further comprises a rim extending from the annular surface portion towards the first surface portion of the bulbous member.

3. The lighting device of claim 1, wherein the SSL elements are mounted on an annular carrier, said annular carrier being supported by the annular surface portion.

4. The lighting device of claim 1, wherein the bulbous member comprises a reflective coating on an inner surface portion centered on an optical axis of the lighting device.

5. The lighting device of claim 4, wherein said coating comprises $TiO_2$.

6. The lighting device of claim 4, wherein said coating covers a circular section of said inner surface portion, wherein the bulbous member has a maximum diameter, and said circular section has a diameter in the range of 25-50% of said maximum diameter.

7. The lighting device of claim 1, wherein the bulbous member is transparent or translucent.

8. The lighting device of claim 1, wherein the bulbous member is made of glass or a polymer.

9. The lighting device of claim 8, wherein the polymer is selected from polycarbonate, polyethylene terephthalate and poly (methyl methacrylate).

10. The lighting device of claim 1, further comprising a fitting, wherein the heat sink further comprises:

a further portion engaging with said fitting; and a plurality of fins extending from the annular portion to said further portion, wherein the plurality of fins is spaced apart such as to define a plurality of light exit windows in between said fins.

11. The lighting device of claim 1, wherein the SSL elements are light emitting diodes.

12. The lighting device of claim 1, wherein the lighting device is a light bulb.

13. A luminaire comprising the lighting device of claim 1.

14. The lighting device of claim 1, wherein the bulbous member has a wall thickness in the range of 20%-50% of the width of an individual SSL element on said annular surface portion.

* * * * *